US007522743B2

(12) United States Patent
Dobras et al.

(10) Patent No.: US 7,522,743 B2
(45) Date of Patent: Apr. 21, 2009

(54) HIGH COMFORT SOUND DELIVERY SYSTEM

(75) Inventors: David Q. Dobras, San Francisco, CA (US); Jon C. Taenzer, Los Altos, CA (US)

(73) Assignee: Step Communications, San Jose, CA (US)

( * ) Notice: Subject to any disclaimer, the term of this patent is extended or adjusted under 35 U.S.C. 154(b) by 439 days.

(21) Appl. No.: 10/766,290

(22) Filed: Jan. 27, 2004

(65) Prior Publication Data

US 2005/0078847 A1 Apr. 14, 2005

Related U.S. Application Data

(63) Continuation-in-part of application No. 10/336,235, filed on Jan. 3, 2003, now abandoned, which is a continuation of application No. 10/041,771, filed on Jan. 7, 2002, now abandoned.

(51) Int. Cl.
*H04R 1/10* (2006.01)

(52) U.S. Cl. ..... 381/381; 381/330; 381/380; 381/324; 181/22; 181/129; 181/130

(58) Field of Classification Search ..... 381/381, 381/375, 338, 330, 385, 324, 328, 329, 380, 381/382, 384, 336, 91, 355, 361–362, 364, 381/376; 181/129, 132, 135, 130
See application file for complete search history.

(56) References Cited

U.S. PATENT DOCUMENTS

| | | | | | |
|---|---|---|---|---|---|
| 3,813,499 | A * | 5/1974 | Vignini | ..... | 381/330 |
| 4,381,830 | A * | 5/1983 | Jelonek et al. | ..... | 181/129 |
| 4,864,610 | A * | 9/1989 | Stevens | ..... | 379/431 |
| 5,737,436 | A * | 4/1998 | Boyden | ..... | 381/385 |
| 5,975,235 | A * | 11/1999 | Schlaegel et al. | ..... | 181/129 |
| 6,009,183 | A * | 12/1999 | Taenzer et al. | ..... | 381/330 |
| 7,027,608 | B2 * | 4/2006 | Fretz et al. | ..... | 381/330 |
| 2002/0181728 | A1 * | 12/2002 | Connors et al. | ..... | 381/381 |

* cited by examiner

*Primary Examiner*—Wayne R Young
*Assistant Examiner*—Dionne H Pendleton
(74) *Attorney, Agent, or Firm*—Henneman & Associates, PLC; Larry E. Henneman, Jr.

(57) ABSTRACT

A high comfort sound delivery system (10) for use with a personal communications device such as a telephone. The high comfort sound delivery system (10) has a behind-the-ear member (12) for holding the device on or near an ear of the user, and a sound horn (14) to be positioned at or near the ear canal of the user. Sound is produced by a speaker (26) in a speaker enclosure portion (15) of the behind-the-ear piece (12) and is delivered to the sound horn (14) through a generally flexible connecting member (16). Rotational adjustment is provide to rotating the connecting member (16) in relation to a speaker tube connection projection (20) and/or a sound horn tube connection projection (46). A length adjustment is provided by moving an elongated portion (66) of the connecting member (16) of the sound horn tube connection projection (46). Alternate sound horn bodies (42*a*, 42*b*, 42*c*, 42*d*, 42*e*, 42*f*) provide addition rotational adjustment points.

31 Claims, 4 Drawing Sheets

HIGH COMFORT SOUND DELIVERY SYSTEM

RELATED APPLICATIONS

This application is a continuation-in-part of U.S. patent application Ser. No. 10/336,235 filed on Jan. 3, 2003 now abandoned by the same inventors, which is a continuation of U.S. patent application Ser. No. 10/041,771 filed on Jan. 7, 2002 now abandoned. These applications are incorporated herein by reference in their entirety.

TECHNICAL FIELD

The present invention relates to the field of audio transducer earpiece devices, and more particularly to an earpiece for use with electronic communications devices. The predominant current usage of the present inventive high comfort sound delivery system is in conjunction with portable personal communications devices, such as cellular or cordless telephones, two way radios, and the like, wherein it is desirable to have an apparatus for delivering sound to the ear of the user in a manner which does not cause discomfort to the user even when used over extended periods of time.

BACKGROUND ART

Personal two way communications devices are becoming ever more popular. The use of cellular telephones is becoming more and more a part of everyday life, and the use of cordless telephone devices continues to increase. Also, the introduction of family radio services two way radios into the market place has greatly increased the popularity and usage of two way radios.

It has long been known in the industry to use a headset device for producing sound from such devices such that the user can hear the sound while others thereabout cannot. Also, an advantage of headset devices in general is that ambient noises are somewhat blocked while the desired sound is projected generally directly into the ear canal of the user. Therefore, the user can hear the desired sound even over significant ambient noise.

A more recent development in the field has been the introduction of earpiece devices into the market. An earpiece performs the general functions of a headset while being less bulky and obtrusive. An earpiece is affixed generally on or in one ear of the user. A sound producing earpiece may be used in conjunction with a separate microphone or sound pick up device, or else a microphone may optionally be incorporated into the earpiece such that a single apparatus will both convert the audio voice signals from the user into an electrical signal and also covert electrical signals from an attached device into audio signals intended to be heard by the user.

Another development in the field has been to provide a flexible connection between a main earpiece body and a portion of the earpiece which fits in or near the ear canal of the user. U.S. patent application Ser. No. 09/870,398 entitled PERSONAL COMMUNICATIONS EARPIECE, and assigned to the assignee of this present application, teaches an example of such an earpiece.

It has been known to construct an earpiece with a separate sound delivery means that places a small speaker in an enclosure at the opening of the ear canal and which connects the speaker to a behind-the-ear member with a flexible two conductor electrical cable. Also known in the art are earpieces which place a speaker inside a behind-the-ear member, and which funnel sound produced by the speaker through a small diameter tube with an open end of the tube in the user's ear canal. Both of these types of construction have proven effective and useful for their intended purposes. However, with the increased use of cellular telephones, and the like, many users wish to keep their earpiece on their ear for all or most of the working day. Such extended periods of usage make desirable an even more comfortable and adaptable type of earpiece.

U.S. Pat. No. 5,975,235 entitled SEATING MEMBER FOR CONNECTING A CONTINUOUS FLOW EARMOLD TUBING CONNECTOR TO AN EARMOLD teaches a communication device sound delivery tube system which can be used in either ear. However, this patent teaches the use of a tube which is placed inside the ear canal. Many people find this to be a solution which is useful for short periods of time, but which may be uncomfortable, especially when used for extended periods of time. Indeed, since the invention of the '235 patent is intended for use with a hearing aid, it is considered to be necessary that the earpiece generally entirely occlude the ear canal of the user. Otherwise, the high gain of the hearing aid amplifier would cause feedback of the sound "leaking" out of the user's ear. Therefore, there are several important aspects of the '235 invention which make it particularly useful for hearing aid applications, but particularly inappropriate for applications such as cellular telephone usage. That is, since the earpiece according to the '235 patent is supported within the ear canal of the user, there need be no particular means for holding the distal end thereof in a fixed position relative to the ear canal, nor does the '235 patent teach such a means. It should be noted that the '235 patent does teach an apparatus which is highly adjustable in a rotational sense, which is particularly desirable since the fully occluding earpiece necessary to the intended application tends to be quite uncomfortable over time, and that adjustment should help to alleviate that discomfort. However, the relatively complex mechanism of that apparatus still does not provide for a full three dimensional adjustment.

Like the '235 patent, U.S. Pat. No. 6,009,183 entitled AMBIDEXTROUS SOUND DELIVERY SYSTEM teaches a communication device sound delivery tube system which is adjustable such that it can be used in either ear. Also like the '235 patent, the device taught and claimed in the '183 patent does not provide any means for the adjustment of the distal portion thereof fully in all axes of rotation.

Yet another prior art device which has provided an improvement in the field is described in U.S. Pat. No. 4,864,610 entitled EARPIECE FOR A TELEPHONE HEADSET. However, even though the invention of the '610 patent is intended for use with a telephone set, a "sound tip" of that invention has its distal portion inserted well into the ear, and a remainder of the tip portion supported by the outer ear. In this invention, also, although there is no aspect which provides for adjustment in all three physical dimensions, there would seem to be no particular need for such adjustment since the ear of the user, itself, provides much of the support. In addition, the invention taught by the '610 patent is a highly ear occluding device, which inherently positions the delivery end of the mechanism and minimizes any need for adjustability.

Still another prior art device is described and claimed in U.S. Pat. No. 6,009,183 entitled AMBIDEXTROUS SOUND DELIVERY TUBE SYSTEM, which patented invention has an inventor in common with this present invention. As with the previously discussed invention, while the '183 invention provides an improvement in the field, the earpiece thereof can be rotated, but there is generally no other significant adjustment provided by the described apparatus.

Also known in the art is an earphone type device for use in applications where it is important to keep conversations from being overheard by others. This device has a speaker apparatus which is clipped below the collar, and wherein sound is delivered through a long tube to the ear. The tube of this device is tipped with an earmold shaped end. The earmold is nearly totally occluding, so the sound is unnatural, and for comfort the earmold must be custom shaped for the individual user's ear which is generally not a desirable feature for a consumer product.

Prior art also includes other hearing health devices, for use by hearing impaired persons, or the like, which provide sound delivery to the ear through a tube. As discussed briefly herein before, unlike a communication only device, these products employ high acoustic gain and, therefore, require high occlusion to prevent feedback "squeal". High occlusion is achieved through custom earmolds or nearly occluding foam tips on the ends of the tubes, but such high occlusion makes the sound of the user's own voice very unnatural and disturbing to the user.

Also known in the art are headset devices whereby sound is delivered to the ear through a tube from a speaker at the chest.

To the inventors' knowledge, the above described types of earpieces represent the prior state of the art in earpiece comfort. It is believed that prior art devices, while being useful for their intended purposes, have not provided a solution wherein user comfort, sound quality, feedback prevention, and other desirable qualities are found without significant sacrifice of at least one of these qualities in favor of another.

DISCLOSURE OF INVENTION

Accordingly, it is an object of the present invention to provide a communications earpiece which will be comfortable to wear, even for extended periods of time.

It is another object of the present invention to provide a communications earpiece which is adjustable in order to accommodate different wearers and preferences.

It is still another object of the present invention to provide a communications earpiece wherein a user can vary the amount of occlusion of the ear canal by the device.

It is yet another object of the present invention to provide a communications earpiece which is adaptable to either the left or the right ear of the user.

It is still another object of the present invention to provide a communications earpiece wherein a speaker is protected from damage.

It is yet another object of the present invention to provide a communications earpiece wherein problems with broken speaker wires are minimized.

It is still another object of the present invention to provide a communications earpiece which can accept a relatively large speaker, thereby improving sound quality and/or reliability.

It is yet another object of the present invention to provide a communications earpiece wherein that portion thereof which is supported in or near the ear canal is light in weight, thereby improving comfort and decreasing the likelihood that such portion will become dislodged and/or fall out of the ear.

It is still another object of the present invention to provide a communications earpiece that includes a behind-the-ear support member and, with respect to such support member, three axis of adjustability of the position of a sound delivery member, such that the sound delivery member can be maintained in very close proximity to the ear canal without requiring support from or pressure on the ear canal tissue.

Briefly, the current invention utilizes a sound horn enclosure at the ear canal. In the present invention there is no speaker within the sound horn enclosure. A speaker is located in a behind-the-ear member, and sound is delivered by a small tube from the speaker to the sound horn enclosure, and delivered by the sound horn enclosure to the ear canal of the user. The sound horn enclosure is thereby the termination of the tube that carries the sound from the speaker, and also is the sound interface to the ear canal of the user.

The objects and advantages of the present invention will be illustrated herein in view of the description of modes of carrying out the invention, and the industrial applicability thereof, as described herein and as illustrated in the several figures of the drawing. The objects and advantages listed herein are not an exhaustive list of all possible advantages of the invention. Moreover, it will be possible to practice the invention even where one or more of the intended objects and/or advantages might be absent or not required in the application.

Further, those skilled in the art will recognize that various embodiments of the present invention may achieve one or more, but not necessarily all, of the above described objects and advantages. Accordingly, the listed advantages are not essential elements of the present invention, and should not be construed as limitations.

DETAILED DESCRIPTION OF THE INVENTION

Figure 1:
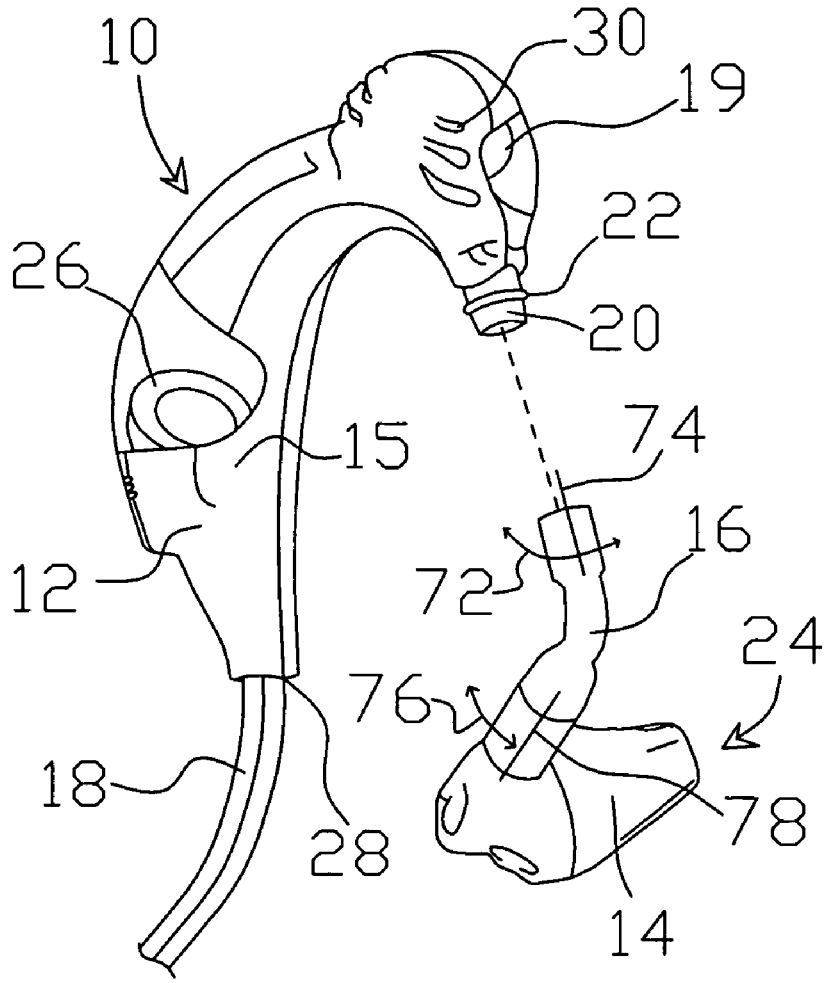
FIG. 1 is a partially cut away, partially exploded perspective view of an example of a high comfort sound delivery system according to the present invention.

The embodiments and variations of the invention described herein, and/or shown in the drawings, are presented by way of example only and are not limiting as to the scope of the invention. Unless otherwise specifically stated, individual aspects and components of the invention may be omitted or modified, or may have substituted therefore known equivalents, or as yet unknown substitutes such as may be developed in the future or such as may be found to be acceptable substitutes in the future. The invention may also be modified for a variety of applications while remaining within the spirit and scope of the claimed invention, since the range of potential applications is great, and since it is intended that the present invention be adaptable to many such variations.

An example of a mode for carrying out the invention is a high comfort sound delivery system. The inventive high comfort sound delivery system is depicted in a partially cut away, partially exploded, perspective view in FIG. 1 and is designated therein by the general reference character 10. The high comfort sound delivery system 10 has a behind-the-ear member 12, and a sound horn 14. The behind-the-ear member 12 has a speaker enclosure portion 15. A connecting member 16 joins the behind-the-ear member 12 to the sound horn 14. In the example of FIG. 1 an electrical wire 18 is provided to allow the high comfort sound delivery system 10 to communicate electrically with a telephone or other such device. However, it is within the scope of the invention that the high comfort sound delivery system 10 could readily be made a "wireless" device with no such external means for electrical connection. In many applications, the behind-the-ear member 12 will have a microphone 19 therein (as shown in the example of FIG. 1), or attached thereto, in order to provide for two way communications.

It should be noted that there are many possible shapes and configurations which could be substituted for the behind-the-ear member 12 illustrated in the example of FIG. 1. Indeed, it is within the scope of the invention that this portion of the invention could be embodied in a housing which goes over the ear, partially encircles the ear, is supported by the ear, or the like. In any event, according to the present invention, the behind-the-ear member 12, or equivalent, will have in the speaker enclosure 15 a speaker 26, or other such transducer, for converting electrical energy to an acoustic signal.

As can be seen in the view of FIG. 1, the behind-the-ear member 12 has a speaker tube connection projection 20 with a retaining ring 22 thereon for connection to an acoustic transfer apparatus 24. These will be discussed in greater detail hereinafter.

It is generally desirable to have some apertures in the behind-the-ear member 12 in order to allow the passage of air and/or sound therethrough. In the example of FIG. 1, a wire passage 28 wherethrough the electrical wire 18 passes is larger than is necessary to accommodate the electrical wire 18, such that air can pass therethrough to allow free movement of the speaker 26. Alternatively, air ports could be provided elsewhere in the behind-the-ear member 12 to serve this purpose. Also, in the example of FIG. 1, a plurality (six in this example, three of which are visible in the view of FIG. 1) of sound ports 30 are provided to admit sound into the microphone 19.

Figure 4:
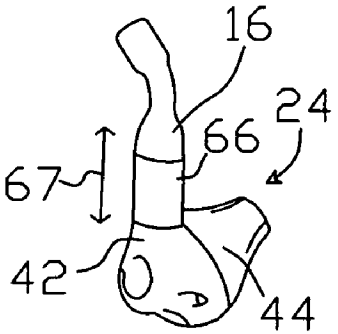
FIG. 4 is a rear perspective view of the acoustic transfer apparatus of the example of FIGS. 1, 2 and 3.
Figure 3:
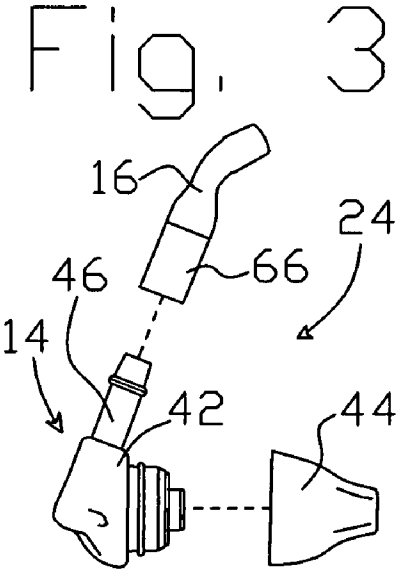
FIG. 3 is a partially exploded side elevational view of the acoustic transfer apparatus of the example of FIGS. 1 and 2.
Figure 2:
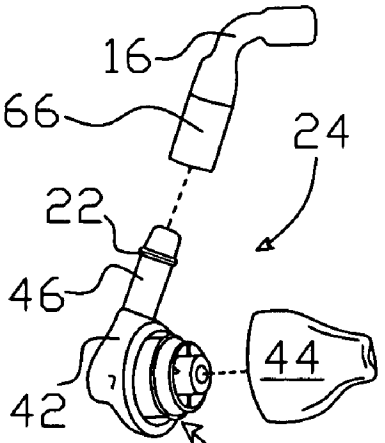
FIG. 2 is a partially exploded perspective view of the acoustic transfer apparatus of the example of FIG. 1.

FIG. 2 is a partially exploded perspective view of the acoustic transfer apparatus 24 of the example of FIG. 1, FIG. 3 is a partially exploded side elevational view of the acoustic transfer apparatus 24 of FIG. 1, and FIG. 4 is a rear perspective view of the acoustic transfer apparatus 24 of FIG. 1. The acoustic transfer apparatus 24 has the connecting member 16 for connecting the behind-the-ear member 12 (FIG. 1) to the sound horn 14. The connecting member 16 is hollow such that sound passes therethrough from the speaker 26 (FIG. 1) to the sound horn 14. As can be seen in the view of FIG. 2, the sound horn 14 has a sound horn body 42 and an inverse horn 44. In the example of the invention shown, the sound horn body 42 is made of a generally rigid material, and the inverse horn 44 is made from a generally flexible material, since the inverse horn 44 is intended to be placed at or near the ear canal of the user, and the flexible material might be somewhat more comfortable than would a rigid material. However, it is not necessary to the invention that the types of materials used in the example of FIGS. 1 and 2 be used. In the view of FIG. 2 can also be seen a sound horn tube connection projection 46 extending from the sound horn body 42. The sound horn tube connection projection 46 is provided with a retaining ring 22.

Figure 5:
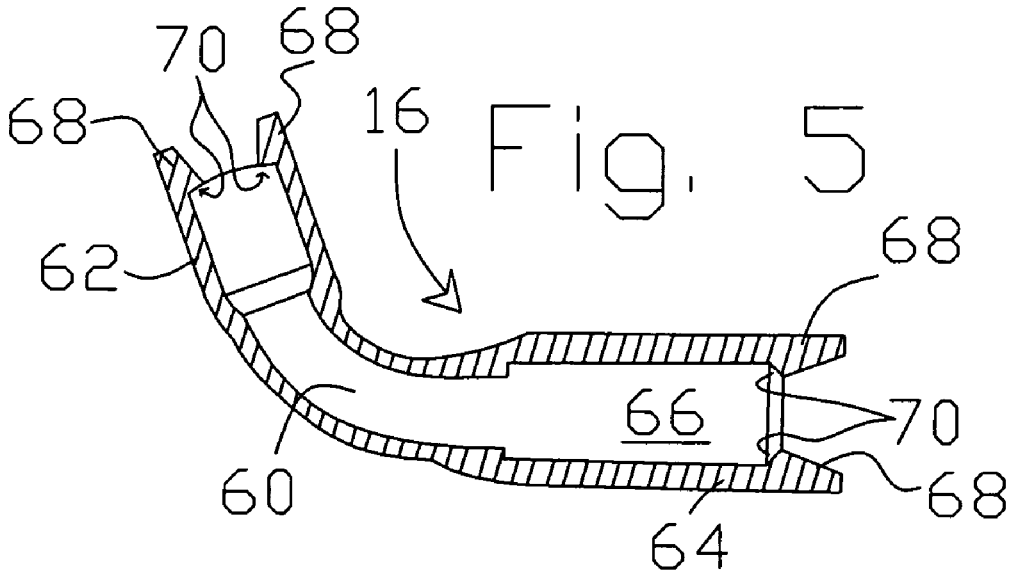
FIG. 5 is a cross sectional side elevational view of the connecting member of FIGS. 1, 2, 3 and 4.

FIG. 5 is a cross sectional side elevational view of the connecting member 16 of FIGS. 1, 2, 3 and 4. In the view of FIG. 5 it can be seen that the connecting member 16 has a generally central preformed curved portion 60. The preformed curved portion 60 is curved, as appropriate for the particular design, such that the attached inverse horn 44 is positioned generally near the ear canal of the user and is pointed generally directly thereinto. The flexible curved portion 60 is, however, sufficiently flexible to allow for some adjustment of the position of the inverse horn 44 independent of other means of adjustment described herein. The connecting member 16 has a speaker enclosure attachment portion 62 at one end thereof and a sound horn attachment portion 64 at the other. The speaker enclosure attachment portion 62 and the sound horn attachment portion 64 are sufficiently flexible and are shaped such that they can be pushed over the speaker tube connection projection 20 (FIG. 1) and the sound horn tube connection projection 46 (FIG. 2), respectively.

In the embodiment shown and described in FIGS. 1 through 5, the sound horn attachment portion 64 has an elongated portion 66 into which is inserted the sound horn tube connection projection 46. As can be seen in the view of FIG. 3, the sound horn tube connection projection 46 is also somewhat elongated. Therefore, the overall effective length of the connecting member 16 can be adjusted, without violating the acoustic seal, by moving the sound horn tube connection projection 46 in or out within the sound horn attachment portion 64, as indicated by the bidirectional arrow 67 in FIG. 4.

Both the speaker enclosure attachment portion 62 and the sound horn attachment portion 64 have a connection lip 68 on the interior surface of the respective ends thereof, as can be seen in the view of FIG. 5. The connection lips are beveled, as shown in the view of FIG. 5, to allow the speaker enclosure attachment portion 62 and the sound horn attachment portion 64 to be pushed over the speaker tube connection projection 20 (FIG. 1) and the sound horn tube connection projection 46, respectively, and the retaining rings 22 thereof. The speaker enclosure attachment portion 62 and the sound horn attachment portion 64 also each have a retaining ridge 70 on the interior surface thereof. The retaining ridges 70 will engage the respective retaining rings 22 of the speaker tube connection projection 20 (FIG. 1) and the sound horn tube connection projection 46 to prevent the connecting member 16 from inadvertently being pulled away from the behind-the-ear member 12 (FIG. 1) or the sound horn 14 (FIG. 1).

It should be noted that the connecting member 16 can be rotated about the longitudinal axis of the speaker tube connection projection 20 as indicated by rotational arrow 72 in FIG. 1. Such rotation will be around a rotational axis 74. The sound horn 14 can also be rotated, as indicated by rotational arrow 76 about a rotational axis 78. Indeed, one or both of these can be rotated a combined total of approximately one half turn to switch the configuration of the apparatus from that appropriate for use with the user's left ear to that appropriate for use with the user's right ear, or vice versa. It should be noted that since the generally bent shape of the connecting member provides that the rotational axis 74 and the rotational axis 78 are at an angle to each other, rotation about those two axis, in addition to movement along the directional arrow 67 (FIG. 4) as previously discussed herein, all combine to provide for a substantial amount of adjustability of the sound horn 14 in all three physical dimensions in relation to the speaker enclosure portion 15 of the high comfort sound delivery system 10. That is, since the speaker enclosure portion 15 provides the support on the user's ear, rotation about axis 74 moves the sound delivery tip of the inverse horn 44 (FIG. 2) selectively in or out of the ear; rotation about axis 78 moves the sound delivery tip of the inverse horn 44 selectively forward/backward within the ear; and sliding movement along axis 78 moves the tip of the inverse horn 44 selectively up/down within the ear; thus providing full three axis adjustability to the sound delivery end of the inverse horn 44 relative to the ear.

Figure 6:
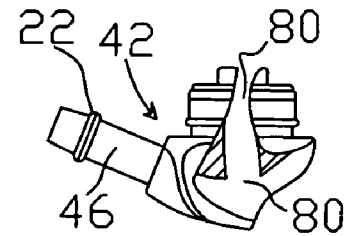
FIG. 6 is partially cut away side view of the example of the sound horn of FIGS. 1, 2, 3 and 4.

FIG. 6 is partially cut away side view of the example of the sound horn body 42 of FIGS. 2, 3 and 4. In the view of FIG. 6 it can be seen that the sound horn body 42 is partially hollow to form a sound passage 80 therethrough such that sound coming through the connecting member 16 (FIG. 3) can pass through the sound passage 80 of the sound horn body 42 and into the inverse horn 44 (FIG. 3).

Figure 7:
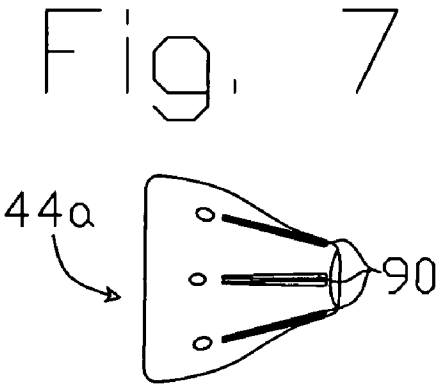
FIG. 7 is a side elevational view of an alternative example of an inverse horn according to the present invention.

FIG. 7 is a side elevational view of an alternative example of an inverse horn 44*a*. As can be seen in the view of FIG. 7, the alternate inverse horn 44*a* has a plurality of grooves 90 distributed about the distal end thereof. The grooves 90 are intended to allow passage of air between the interior of the ear canal of the user and the outside thereof. Alternatively, ridges could be used instead of the grooves 90 to achieve the same purpose. Generally, it will not be intended that either the inverse horn 44 (FIG. 3) or the alternate inverse horn 44*a* entirely occlude the ear canal of the user. The grooves 90 will assist in preventing such occlusion, even if the alternate inverse horn 44*a* is pushed against, or even slightly into, the ear canal. It should be noted that the inverse horn 44 of FIG. 3, or any equivalent parts which are described herein or which might be substituted therefor, could optionally be provided with the grooves 90 as illustrated in FIG. 7.

Figure 8:
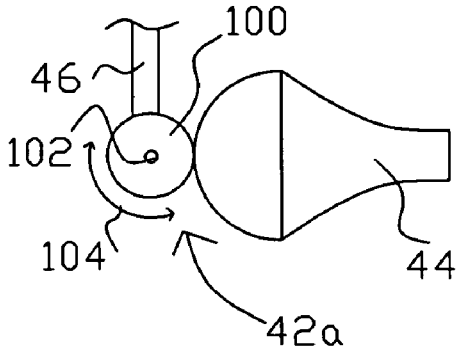
FIG. 8 is a side elevational view of an alternative example of a sound horn body according to the present invention.
Figure 9:
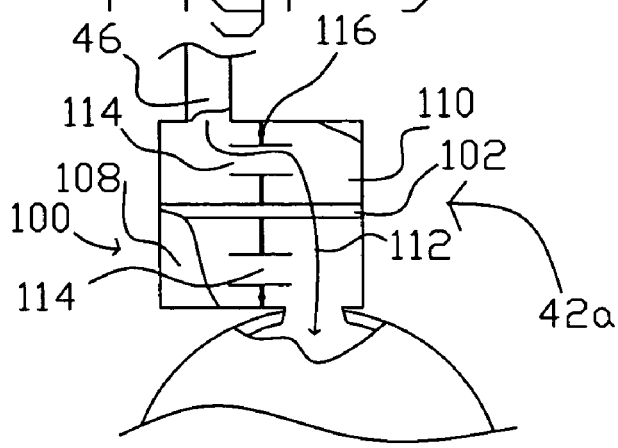
FIG. 9 is a partially cut away top view of the example of FIG. 8.

Yet another aspect of the invention is that the sound horn body 42, or equivalent, can optionally be provided with a pivot apparatus such that it can pivot in relation to the connecting member 16. FIG. 8 is a side elevational view of an alternate example of a sound horn body 42*a* which provides such capability. As can be seen in the view of FIG. 8, the alternate sound horn body 42*a* has a rotational mechanism 100 which allows the alternate sound horn body 42*a* to rotate about a pivot pin 102 as indicated by rotational arrow 104. FIG. 9 is a partially cut away top view of the relevant portion of rotational mechanism 100 of the example of FIG. 8. In the view of FIG. 9 it can be seen that the rotational mechanism 100 has a first half 108 and a second half 110 which are free to rotate in relation to each other about the pivot pin 102. An air path 112 from the sound horn tube connection projection 46 into the alternate sound horn body 42*a* is provided by air passage slots 114 in the first half 108 and the second half 110. An O ring 116 generally prevents the escape of air (and sound) from within the rotational mechanism 110.

Figure 10:
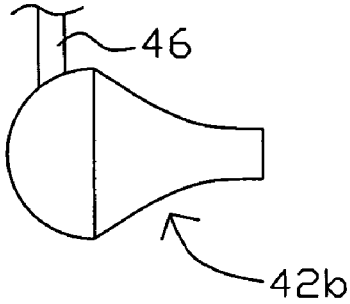
FIG. 10 is a side elevational view of yet another alternative example of a sound horn body according to the present invention.
Figure 11:
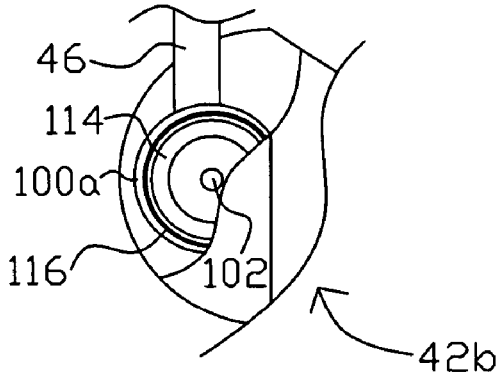
FIG. 11 is a partially cut away side elevational view of the example of FIG. 10.
Figure 12:
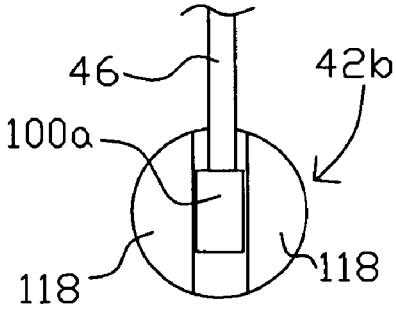
FIG. 12 is a rear elevational view of the example of FIGS. 10 and 11.

FIG. 10 is a side elevational view of yet another alternate example of a sound horn body 42*b*. In the view of FIG. 10 it can be seen that no rotational mechanism is visible from this view of the alternate sound horn body 42*b*. FIG. 11 is a partially cut away side elevational view of a relevant portion of the alternate sound horn body 42*b*. Visible in the view of FIG. 11 is an alternate rotational mechanism 100*a* having the O ring 116, pivot pin 102 and air passage slot 114 as described previously herein. FIG. 12 is a rear elevational view of the alternate sound horn body 42*b*. From the view of FIG. 12 it can be seen that the alternate rotational mechanism 100*a* is located between two lobes 118 of the alternate sound horn body 42*b*. In this embodiment of the invention sound passes from the sound horn tube connection projection 46 through the alternate sound horn body 42*b* and out through the air passage slot 114 (FIG. 11) into the lobes 118, in a manner similar to that described previously herein in relation to the first described embodiment of the rotational mechanism 100.

Figure 13:
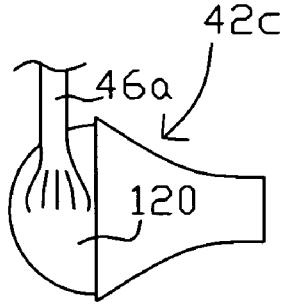
FIG. 13 is a side elevational view of still another alternative example of a sound horn body according to the present invention.

FIG. 13 is a side elevational view of still another alternative example of a sound horn body 42*c*. As can be seen in the view of FIG. 13, an alternate sound horn tube connection projection 46*a* is integral with a first half 120 of the alternate sound horn body 42*a*. The alternate sound horn tube connection projection 46*a* is molded as an integral part of the first half 120 of the alternate sound horn body 42*a* in the embodiment shown, although it is within the scope of the invention that it be formed separately and affixed by some other means such as glue, press fitting, or the like.

Figure 14:
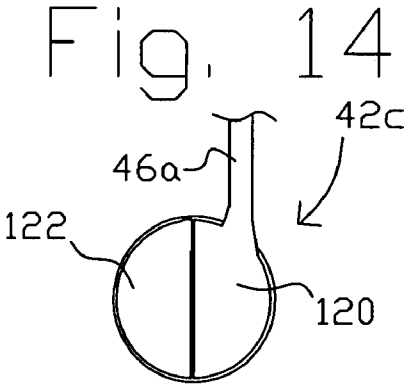
FIG. 14 is a rear elevational view of the example of FIG. 13.

FIG. 14 is a rear elevational view of the example of alternate sound horn body 42*c*. In the view of FIG. 14 it can be seen that a second half 122 of the alternate sound horn body 42*c* is separate from the first half 120. In this embodiment of the invention, the inverse horn 44 (not visible in this view) is affixed to the second half 122 of the alternate sound horn body 42*c*. The first half 120 and the second half 122 are free to rotate in relation to each other in like manner to the first half 108 and the second half 110 of the rotational mechanism 100 previously described herein. Within the alternate sound horn body 42*c* (but not visible in the view of FIG. 14) are the O ring 116, air passage slot 114, and pivot pin 102 as previously described herein in relation to FIGS. 8 and 9.

Figure 15:
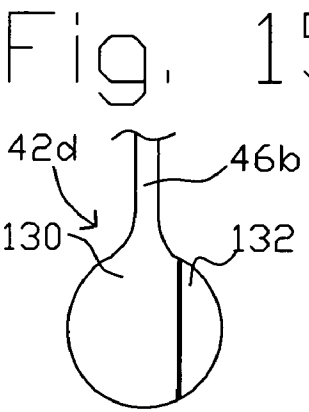
FIG. 15 is a rear elevational view of yet another alternative example of a sound horn body according to the present invention.

FIG. 15 is a -rear elevational view of yet another alternative example of a sound horn body 42*d*. The alternate sound horn body 42*d* differs from the previously described alternate sound horn body 42*c* (FIG. 14) generally only in that a first half 130 and a second half 132 thereof are of unequal size, such that an alternate sound horn tube connection projection 46*b* can be centrally located on the alternate sound horn body 42*d*.

Figure 16:
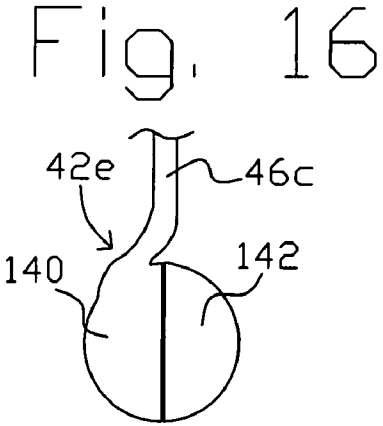
FIG. 16 is a rear elevational view of still another alternative example of a sound horn body according to the present invention.

FIG. 16 is a rear elevational view of yet another alternative example of a sound horn body 42*e*. The alternate sound horn body 42*e* differs from the previously described alternate sound horn body 42*c* (FIG. 14) generally only in that an alternate sound horn tube connection projection 46*c* is formed so as to allow the projection thereof to be generally centrally located on the alternate sound horn body 42*e* while the first half 140 and the second half 142 of the alternate sound horn body 42*e* remain generally equal in size.

Figure 17:
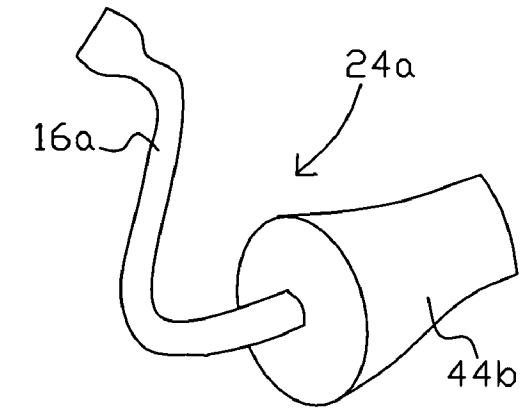
FIG. 17 is a perspective view of an alternative example of an acoustic transfer apparatus according to the present invention.

FIG. 17 is a perspective view of an alternative example of an acoustic transfer apparatus 24*a*. The alternate acoustic transfer apparatus is but one of many possible examples of a device which incorporates some, but not all, of the present inventive features. In the alternate acoustic transfer apparatus, an alternate connecting member 16*a* is affixed directly to an alternate inverse horn 44*b*.

Figure 18:
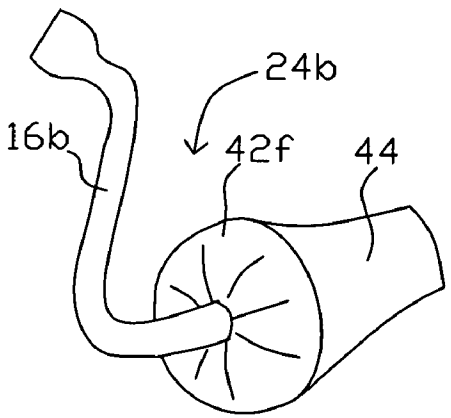
FIG. 18 is a perspective view of yet another alternative example of an acoustic transfer apparatus according to the present invention.

FIG. 18 is a perspective view of yet another alternative example of an acoustic transfer apparatus 24*b*. In the example of FIG. 18, an alternate connecting member 16*b* is connected directly to an alternate sound horn body 42*f* which has affixed thereto an inverse horn 44 not unlike those previously described herein. In the alternative embodiments shown in FIGS. 17 and 18, the three axis adjustability of the invention is implemented by the use of a very soft connecting member (16*a* and 18*b*, respectively).

Various modifications may be made to the invention without altering its value or scope. For example, the exact shapes of the various parts of the invention which are shown and described herein are at least partially somewhat arbitrary and intended for visual appeal. Significant cosmetic changes could be made in the devices without altering their inventive purpose or function. The earbud shaped inverse horn 44, and alternatives, could be formed in a great many alternative shapes and configurations without departing from the essence of the invention. For example, inverse horn 44 could be molded as a single unit with the sound horn body 42. The materials described herein could also be varied. Additionally, as discussed briefly previously herein, one or more of the several adjustments discussed herein could be eliminated without changing the value or scope of the invention. Since so many points of adjustment are provided, functionality of the inventive devices would not be substantially altered, in at least some applications, if some or all of the rotational or length adjustments were eliminated and/or if some of the flexibility of the flexible components described herein were reduced or eliminated.

Yet another obvious modification would be to vary the connection points and/or manner of the connecting member 16. For example, the embodiment of the invention described herein in relation to FIG. 1 shows rotational connections on both ends of the connecting member 16. It would also be within the intended scope of the invention to have the connecting member 16 enter the behind-the-ear member 12 and be terminated internally thereto.

All of the above are only some of the examples of available embodiments of the present invention. Those skilled in the art will readily observe that numerous other modifications and alterations may be made without departing from the spirit and scope of the invention. Accordingly, the disclosure herein is not intended as limiting and the appended claims are to be interpreted as encompassing the entire scope of the invention.

INDUSTRIAL APPLICABILITY

The inventive high comfort sound delivery system 10 and equivalents are intended to be widely used in conjunction with a variety of personal communications devices such as cellular and cordless telephones and two way radio devices. Particularly in the case of cellular telephones, it is known that having a hands free type of apparatus provides a significant safety function, particularly when the user is driving an automobile or otherwise engaged in some other activity. The fact that the design of the present inventive high comfort sound delivery system 10 allows the inverse horn 44 to be readily positioned such that it does not completely block or occlude the ear canal of the user enhances the safety and convenience of the invention, in that the user's hearing is not significantly impaired. According to the present invention, the inverse horn 44 is positioned at, but not necessarily in, the ear canal, and the inverse horn 44 can be adjusted to a position directly at the ear canal without applying pressure to the tissue at or in the ear canal of the user.

Additionally, the fact that the high comfort sound delivery system 10 is comfortable and convenient to wear will increase the likelihood that the devices will be used, as opposed to holding a cellular telephone, or the like, in one hand of the user. The design and function of the present invention will help to prevent feedback, in that sound is directed into the ear canal of the user, while providing the comfort and safety of allowing the reception of ambient sound by the user.

Since the high comfort sound delivery system 10 and equivalents of the present invention may be readily produced and integrated with existing cellular telephones and other such devices, and since the advantages as described herein are provided, it is expected that it will be readily accepted in the industry. For these and other reasons, it is expected that the utility and industrial applicability of the invention will be both significant in scope and long-lasting in duration.

We claim:

1. A communications earpiece comprising:

a transducer enclosure portion;

a transducer housed generally within the transducer enclosure portion;

a sound horn; and a generally tubular connection member for channeling sound from the transducer enclosure portion to the sound horn; wherein the connection member has a first adjustment means for allowing rotation of the connection member relative to the transducer enclosure portion;

the connection member has a second adjustment means for allowing movement of the sound horn selectively toward and/or away from the transducer enclosure portion and for allowing rotation of the sound horn in relation to the connection member;

the second adjustment means includes a generally hollow cylindrical projection on the sound horn engaging a hollow cylindrical end portion on the connection member;

the second adjustment means include a retainer having a raised ring on one of the hollow cylindrical projection on the sound horn and the hollow cylindrical end portion on the connection member and a retaining ridge on the other of the hollow cylindrical projection on the sound horn and the hollow cylindrical end portion on the connection member; and the raised ring abuts the retaining ridge when the sound horn is moved longitudinally away from the connection member such that the retainer facilitates positional adjustment between the sound horn and the connection member but prevents disengagement of the connection member and the sound horn.

2. The communications earpiece of claim 1, wherein:

the first adjustment means includes a generally hollow cylindrical projection on the transducer enclosure and a hollow cylindrical end portion on the connection member.

3. The communications earpiece of claim 2, wherein:

the cylindrical end portion is rotatably affixed to the cylindrical projection of the first adjustment means.

4. The communications earpiece of claim 2, wherein:

the cylindrical end portion is rotatably affixed over the cylindrical projection of the first adjustment means.

5. The communications earpiece of claim 1, wherein:

the cylindrical end portion of the second adjustment means is slidably affixed to the cylindrical projection of the second adjustment means such that the cylindrical end portion can be moved longitudinally along at least a portion of the length of the cylindrical projection.

6. The communications earpiece of claim 1 wherein:

the cylindrical end portion of the second adjustment means is slidably affixed over the cylindrical projection of the second adjustment means such that the cylindrical end portion can be moved longitudinally along at least a portion of the length of the cylindrical projection.

7. The communications earpiece of claim 1 wherein:

the cylindrical end portion of the second adjustment means is rotatably affixed to the cylindrical projection of the second adjustment means.

8. The communications earpiece of claim 1, wherein:

the cylindrical end portion of the second adjustment means is rotatably affixed over the cylindrical projection of the second adjustment means.

9. The communications earpiece of claim 1, wherein:

the connection member is bent, such that the connection member can rotate in relation to the transducer enclosure portion about a first axis; and the sound horn can rotate in relation to the connection member about a second axis.

10. The communications earpiece of claim 1, wherein:

the transducer enclosure portion is adapted for hooking over the top of the user's ear.

11. A communications earpiece, comprising:

a transducer enclosure portion including a first generally hollow projection;

a transducer housed generally within the transducer enclosure portion;

a sound horn including a second generally hollow projection; and a generally tubular connection member for channeling sound from the transducer enclosure portion to the sound horn;

a first retainer including a raised ring on one of a first end of the connection member and the first hollow projection and a retaining ridge on the other of the first end of the connection member and the first hollow projection;

a second retainer including a raised ring on one of a second end of the connection member and the second hollow projection and a retaining ridge on the other of the first end of the connection member and the second hollow projection; and wherein the connection member is rotatably affixed at the first end to the first generally hollow projection; and the connection member is rotatably affixed at the second end to the second generally hollow projection; and the connection member can be moved longitudinally along at least a portion of the length of at least one of the first generally hollow projection and the second generally hollow projection;

the raised ring of the first retainer abuts the retaining ridge of the first retainer such that the first retainer facilitates positional adjustment between the connection member and the first generally hollow projection but prevents disengagement of the connection member and the first generally hollow projection; and the raised ring of the second retainer abuts the retaining ridge of the second retainer such that the second retainer facilitates positional adjustment between the connection member and the second generally hollow projection but prevents disengagement or the connection member and the second generally hollow projection.

12. The communications earpiece of claim 11, wherein:

the first end of the connection member fits over the first generally hollow projection; and the second end of the connection member fits over the second generally hollow projection.

13. The communications earpiece of claim 11, wherein:

the connection member is bent such that the connection member can rotate in relation to the transducer enclosure portion about a first axis; and the sound horn can rotate in relation to the connection member about a second axis.

14. The communications earpiece of claim 11, wherein:

the second generally hollow projection is elongated such that the connection member can be moved longitudinally along at least a portion of the length of the second generally hollow projection.

15. In a communications earpiece, an improvement comprising:

a connecting tube for connecting and acoustically coupling a transducer enclosure to an ear bud;

an elongated projection connected to at least one of the transducer enclosure and the ear bud for insertion into one end of the connecting tube; and a retainer including a raised ring on one of the connecting tube and the elongated projection and a retaining ridge on the other of the connecting tube and the elongated projection; and wherein the connecting tube can be rotated about the elongated projection;

the connecting tube can be moved longitudinally along at least a portion of the length of the elongated projection; and the raised ring abuts the retaining ridge when the connecting tube is move longitudinally away from the elongated projection such that the retainer facilitates positional adjustment between the connecting tube and the elongated projection but prevents disengagement of the connecting tube and the elongated projection.

16. The communications earpiece of claim 15, further comprising:

a transducer housed generally within the transducer enclosure; and wherein the ear bud has a sound horn including a reverse horn, the reverse horn having a textured surface and configured for placement in the ear canal of a user, the textured surface operative to vary the amount of occlusion of the ear canal depending on the placement of the sound horn relative to the user's ear canal; and the position of the sound horn is adjustable in relation to the transducer enclosure in all three physical dimensions.

17. The communications earpiece of claim 16, wherein the reverse horn is flexible.

18. The communications earpiece of claim 16, wherein the textured surface includes grooves.

19. The communications earpiece of claim 16, wherein the textured surface includes ridges.

20. The communications earpiece of claim 16, wherein the textured surface provides more occlusion when it is placed relatively deeper into the ear canal.

21. The communications earpiece of claim 1, wherein the retaining ridge is located adjacent a distal end of the cylindrical end portion of the connection member.

22. The communications earpiece of claim 1, wherein:

the retaining ridge is located around an inner surface of the connection member;

the connection member includes an elongated interior portion adjacent a side of the retaining ridge that is opposite to the distal end of the connection member; and the raised ring moves longitudinally within the elongated interior portion when the cylindrical projection of the sound horn is inserted in the connection member.

23. The communications earpiece of claim 22, wherein:

the elongated interior portion defines a first interior diameter of said connection member;

the retaining ridge defines a second interior diameter of said connection member; and the first interior diameter is greater than the second interior diameter.

24. The communications earpiece of claim 22, wherein the raised ring maintains an acoustic seal between the connection member and the cylindrical projection of the sound horn as the raised ring moves longitudinally within the elongated interior portion.

25. The communications earpiece of claim 2, wherein:

the first adjustment means includes a retainer having a raised ring on one of the hollow cylindrical projection on the transducer enclosure and the hollow cylindrical end portion on the connection member and a retaining ridge on the other of the hollow cylindrical projection on the transducer enclosure and the hollow cylindrical end portion on the connection member; and the raised ring abuts the retaining ridge of the retainer of the first adjustment means when the connection member is moved longitudinally away from the transducer enclosure portion such that the retainer facilitates positional adjustment between the connection member and the transducer enclosure portion but prevents disengagement of the connection member and the transducer enclosure portion.

26. The communications earpiece of claim 15, wherein the retaining ridge is located adjacent a distal end of the connecting tube or the elongated projection.

27. The communications earpiece of claim 26, wherein:

the retaining ridge is located around an inner surface of the connecting tube;

the connecting tube includes an elongated interior portion adjacent a side of the retaining ridge that is opposite to the distal end of the connecting tube; and the raised ring moves longitudinally within the elongated interior portion when the elongated projection is inserted in the connecting tube.

28. The communications earpiece of claim 27, wherein:

the elongated interior portion defines a first interior diameter of said connecting tube;

the retaining ridge defines a second interior diameter of said connecting tube; and the first interior diameter is greater than the second interior diameter.

29. The communications earpiece of claim 27, wherein the raised ring maintains an acoustic seal between the connecting tube and the elongated projection as the raised ring moves longitudinally within the elongated interior portion.

30. The communication earpiece of claim 15, wherein the elongated projection is connected to the transducer enclosure, the communication earpiece further comprising:

a second elongated projection connected to the ear bud for insertion into a second end of the connecting tube; and a second retainer including a raised ring on one of the connecting tube and the second elongated projection and a retaining ridge on the other of the connecting tube and the second elongated projection; and wherein the connecting tube can be rotated about the second elongated projection;

the connecting tube can be moved longitudinally along at least a portion of the length of the second elongated projection; and the raised ring of the second retainer abuts the retaining ridge of the second retainer when the connecting tube is moved longitudinally away from the second elongated projection such that the second retainer facilitates positional adjustment between the connecting tube and the second elongated projection but prevents disengagement of the connecting tube and the second elongated projection.

31. The communications earpiece of claim 30, wherein:

the retaining ridge of the retainer is located adjacent a first distal end of the connecting tube around an inner surface of the connecting tube;

the connecting tube includes an elongated interior portion adjacent a side of the retaining ridge of the retainer that is opposite to the first distal end of the connecting tube;

the raised ring of the retainer moves longitudinally within the elongated interior portion when the elongated projection is inserted in the first distal end of the connecting tube;

the retaining ridge of the second retainer is located adjacent a second distal end of the connecting tube around the inner surface of the connecting tube;

the connecting tube includes a second elongated interior portion adjacent a side of the retaining ridge of the second retainer that is opposite to the second distal end of the connecting tube; and the raised ring of the second retainer moves longitudinally within the second elongated interior portion when the second elongated projection is inserted in the second distal end of the connecting tube.

* * * * *